United States Patent [19]

Malosh et al.

[11] Patent Number: 5,070,708

[45] Date of Patent: Dec. 10, 1991

[54] FLOATING FRAME MOUNTING SYSTEM AND METHOD FOR A REFRIGERATOR

[75] Inventors: James B. Malosh, Baroda Township, Berrien county; Jim J. Pastryk, Weesaw Township, Berrien County, both of Mich.

[73] Assignee: Whirlpool Corporation, Benton Harbor, Mich.

[21] Appl. No.: 320,077

[22] Filed: Mar. 6, 1989

Related U.S. Application Data

[63] Continuation-in-part of Ser. No. 139,265, Dec. 29, 1987, abandoned.

[51] Int. Cl.[5] ..... F25D 19/00

[52] U.S. Cl. ..... 62/295

[58] Field of Search ..... 62/295; 417/363

[56] References Cited

U.S. PATENT DOCUMENTS 2,685,178 8/1954 Eck ..... 62/295

4,549,859 10/1985 Andrione et al. ..... 417/363

*Primary Examiner*—William E. Topolcai

*Attorney, Agent, or Firm*—Mason, Kolemainen, Rathburn & Wyss

[57] ABSTRACT

A mounting system for a compressor of a refrigerator includes a floating frame rigidly secured to a compressor housing in which the compressor is resiliently mounted, the floating frame being resiliently secured to the frame of the refrigerator. The floating frame includes a pair of support rails to which the refrigerator's condenser is rigidly secured as well as the compressor housing. In one embodiment the floating frame also includes a cross rail to which a first end of each of the support rails in rigidly secured. By increasing the effective mass of the compressor housing to include the condenser and floating frame the amount of vibration transmitted from the compressor to the refrigerator frame is reduced as well as the noise generated thereby.

9 Claims, 4 Drawing Sheets

PRIOR ART

FLOATING FRAME MOUNTING SYSTEM AND METHOD FOR A REFRIGERATOR

This is a continuation-in-part of U.S. patent application Ser. No. 139,265 filed Dec. 29, 1987, now abandoned.

FIELD OF THE INVENTION

The present invention relates to a refrigerator having a refrigerator frame and a compressor, and more particularly, to a floating frame mounting system disposed between the housing of the compressor and the refrigerator frame to reduce the amount of vibration transmitted from the compressor to the refrigerator frame and thus reduce the noise generated by such vibration.

DESCRIPTION OF THE PRIOR ART

Known refrigerators typically include a compressor which transmits vibration to the frame of the refrigerator thereby generating undesirable noise. One known refrigerator, as shown in FIG. 2, includes a reciprocating compressor with metal springs (not shown) resiliently mounting the compressor in a compressor housing 10. Rubber isolators, only three of which, 11, 12 and 13, are shown, resiliently secure the compressor housing 10 to a pair of support rails 14 and 16. The rails 14 and 16 also support a condenser coil 17 for the refrigerator, the condenser 17 being rigidly secured to the support rails 14 and 16. Respective ends 18 and 19 of the support rails 14 and 16 are rigidly secured to a cross rail 20 that, in turn, is rigidly secured to the front of the refrigerator frame. Similarly, respective ends 22 and 23 of the support rails 14 and 16 are rigidly secured to a cross rail 24 that, in turn, is rigidly secured to the rear of the refrigerator frame. The transmissibility of vibration from the compressor to the refrigerator frame for the configuration of the compressor mounting system shown in FIG. 2 generates noise at a high, undesirable level.

SUMMARY OF THE INVENTION

In accordance with the present invention, the disadvantages of the prior art refrigerator compressor housing mounting systems have been overcome. The mounting system of the present invention includes a floating frame disposed between the housing of the compressor and the refrigerator frame to reduce the amount of vibration transmitted from the compressor to the refrigerator frame and to thus reduce the noise generated thereby.

The mounting system of the present invention is employed for a refrigerator having a refrigerator frame, a condenser, and a compressor resiliently mounted in a compressor housing. The mounting system includes a support frame resiliently attached to the refrigerator frame, wherein the compressor housing and condenser are both rigidly secured to the support frame.

In one embodiment of the present invention, the support frame includes a pair of support rails and the refrigerator includes a pair of cross rails. A first end of each of the support rails is resiliently mounted on one of the cross rails, whereas a second end of each of the support rails is resiliently mounted on the other of the cross rails.

In a second embodiment of the present invention, the support frame includes a pair of support rails and at least one cross rail. The refrigerator frame also includes a cross rail which is rigidly secured thereto. A first end of each of the support rails is rigidly secured to the support frame cross rail wherein the support frame cross rail is resiliently secured to the refrigerator frame. A second end of each of the support rails is resiliently secured to the refrigerator frame cross rail.

The mounting system of the present invention substantially reduces the amount of vibration transmitted from the refrigerator's compressor to the refrigerator frame, and thus the amount of noise generated thereby, by increasing the effective mass of the compressor housing to include the mass of the refrigerator's condenser as well as the mass of the floating frame mounting system.

These and other objects, advantages and novel features of the present invention, as well as details of an illustrative embodiment thereof, will be more fully understood from the following description and the drawing.

DESCRIPTION OF THE PREFERRED EMBODIMENT

Figure 1:
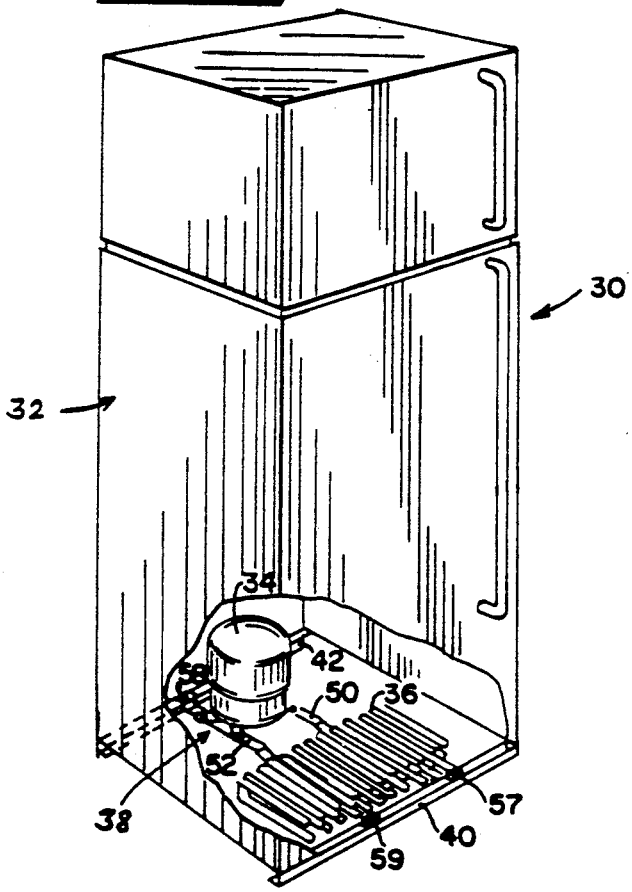
FIG. 1 is a perspective view of a refrigerator cut away to illustrate the location of the mounting system of the present invention.
Figure 2:
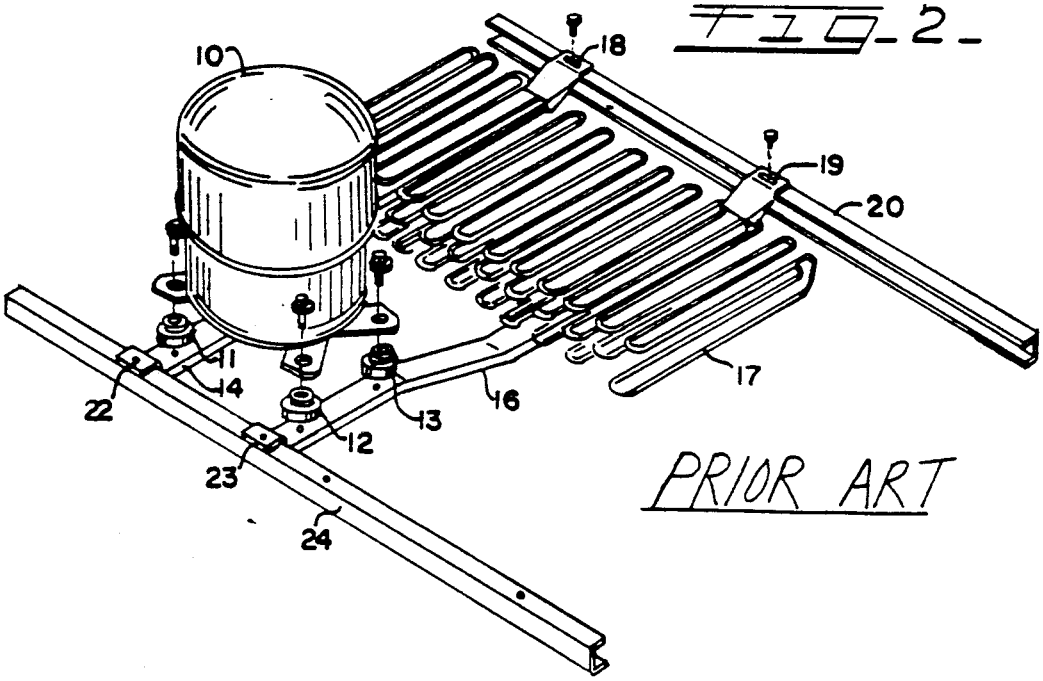
FIG. 2 is a perspective view of a prior art compressor housing mounting system for a refrigerator.

A refrigerator 30, as shown in FIG. 1, constructed in accordance with the principles of the present invention includes a refrigerator frame or shell 32, a reciprocating compressor resiliently mounted by means of metal springs in a compressor housing 34, a condenser coil 36 and a mounting system, generally designated 38. As shown in greater detail in FIG. 5, the compressor housing 34 and condenser 36 are rigidly secured to the mounting system 38 which is, in turn, resiliently mounted on a front cross rail 40 and on a rear cross rail 42. The front and rear cross rails 40 and 42 are rigidly secured to the respective front and back of the refrigerator frame 32. As will be seen from the following discussion of FIGS. 3 and 4, by rigidly securing the compressor housing 34 to the mounting system 38 that also supports the condenser 36, and by further resiliently securing the mounting system 38 to the refrigerator frame 32, the amount of vibration transmitted from the compressor contained within the housing 34 to the refrigerator frame 32 is substantially less than the amount of vibration transmitted to the refrigerator frame for the prior art mounting system depicted in FIG. 2.

Figure 5:
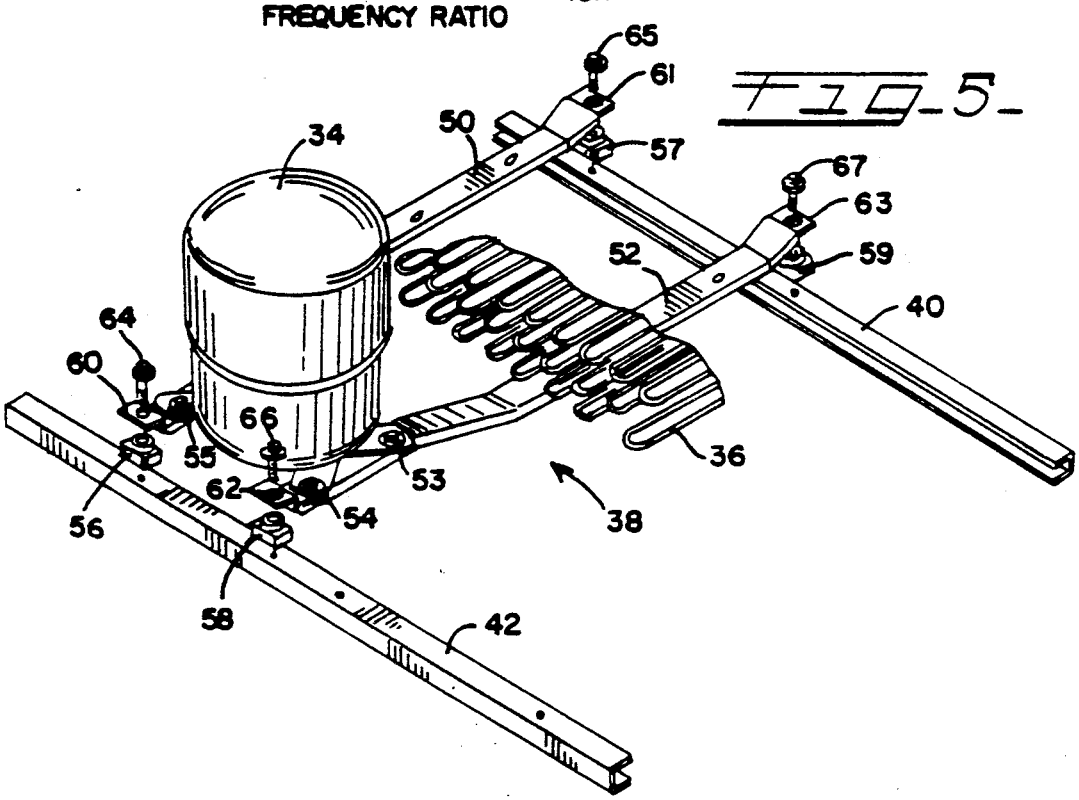
FIG. 5 is a perspective view of a first embodiment of the mounting system of the present invention.
Figure 7:
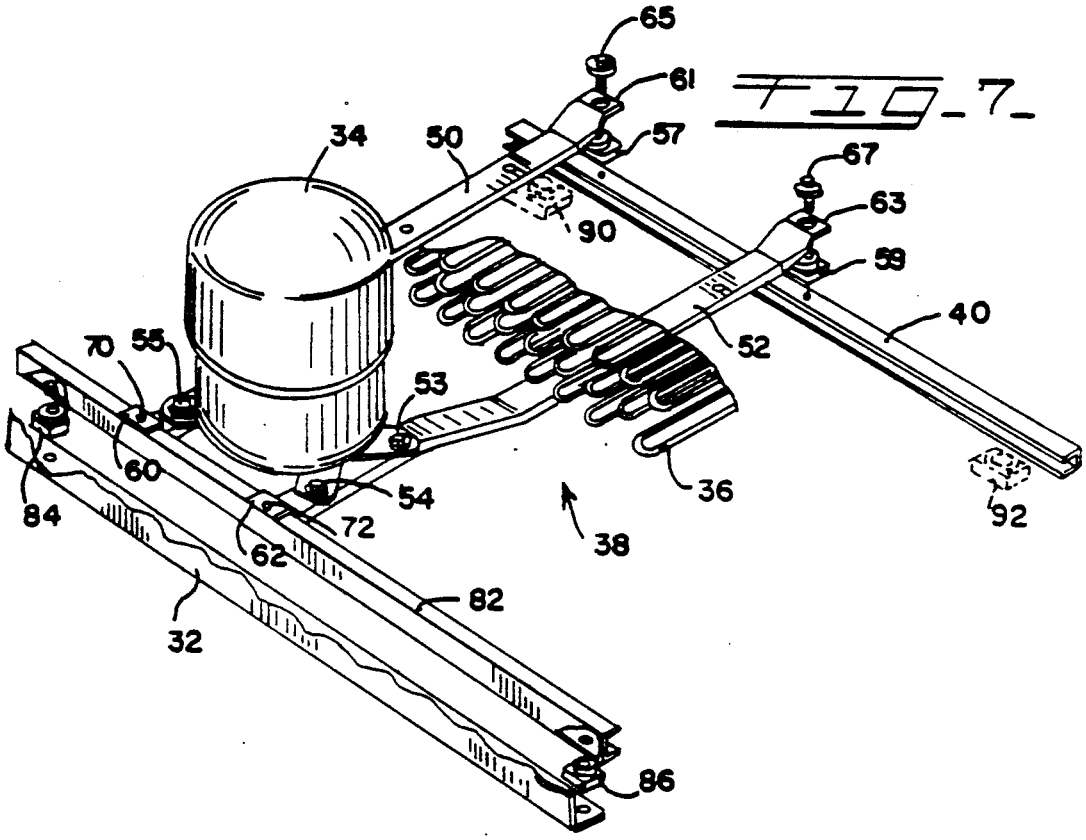
FIG. 7 is a perspective view of a second embodiment of the mounting system of the present invention.
Figure 9:
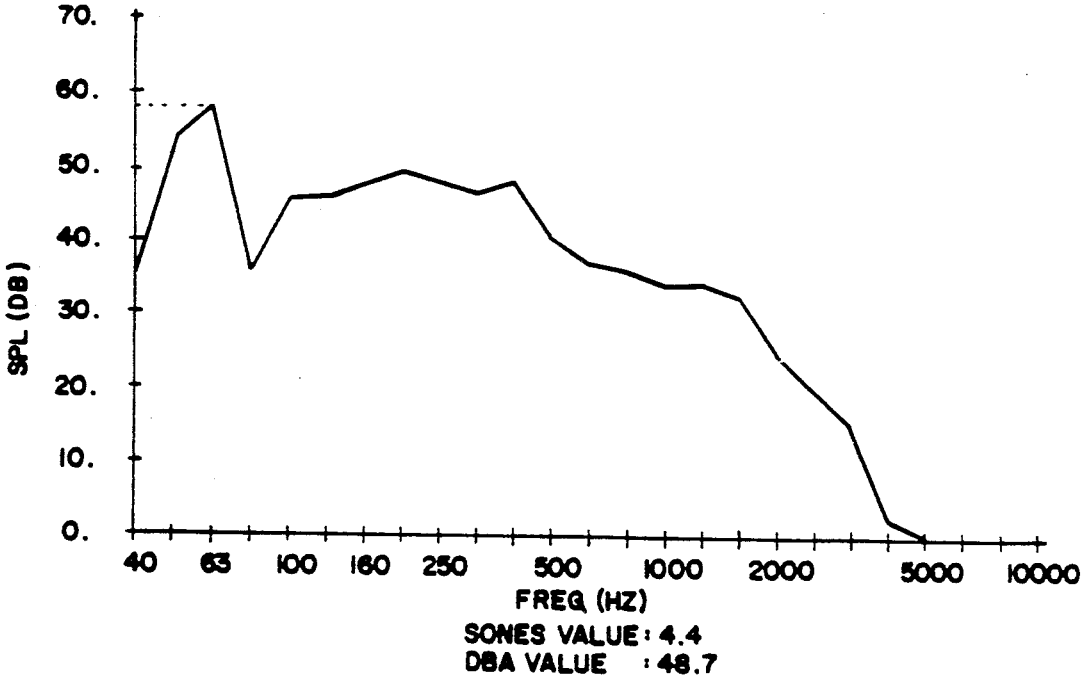
FIG. 9 is a graph illustrating the noise produced by a refrigerator having the compressor mounting system shown in FIG. 2.

The compressor mounting system of the present invention shown in FIGS. 1, 5 and 7 has multiple degrees of freedom. The compressor mounting system may be modeled as having two degrees of freedom as shown in FIG. 3 wherein the resilient compressor mounting within the housing 34 provides one degree of freedom and the apparatus that resiliently secures the mounting system 38 to the frame of the refrigerator provides a second degree of freedom.

Figure 3:
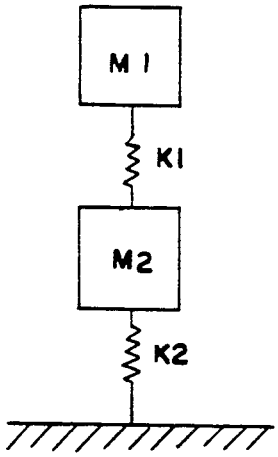
FIG. 3 is a spring mass diagram for the mounting system of the present invention.

More particularly, FIG. 3 is a spring mass diagram for a compressor mounting system having two degrees of freedom with a first mass, M1 and a second mass, M2. In both the systems of the prior art shown in FIG. 2 and of the present invention illustrated in FIGS. 1, 5 and 7, M1 represents the mass of the refrigerator's compressor. The constant K1 represents the spring constant associated with the metal springs (not shown) which resiliently mount the compressor in its housing, housing 10 for the prior art and housing 34 for the system of the present invention. For the prior art system shown in FIG. 2, the mass M2 represents the mass of the compressor housing 10 whereas the constant K2 represents the spring constant associated with the rubber isolators 11–13 which resiliently secure the compressor housing 10 to the support rails 14 and 16 of the prior art mounting system. For the mounting system of the present invention illustrated in FIGS. 1, 5 and 7, the mass M2 represents the effective mass of the compressor, i.e., the sum of the masses of the compressor housing 34, the condenser 36 and the mounting system 38, whereas the constant K2 represents the spring constant associated with the apparatus that resiliently secures the mounting system 38 to the frame of the refrigerator 32 as discussed in detail below with reference to FIGS. 5 and 7. A ratio, $\beta$, equal to the ratio of M2 to M1, is much greater for the system of the present invention shown in FIGS. 1, 5 and 7 than it is for the prior art system shown in FIG. 2 since the effective mass of the compressor housing M2 for the system of the present invention is much greater than that of the prior art.

Figure 4:
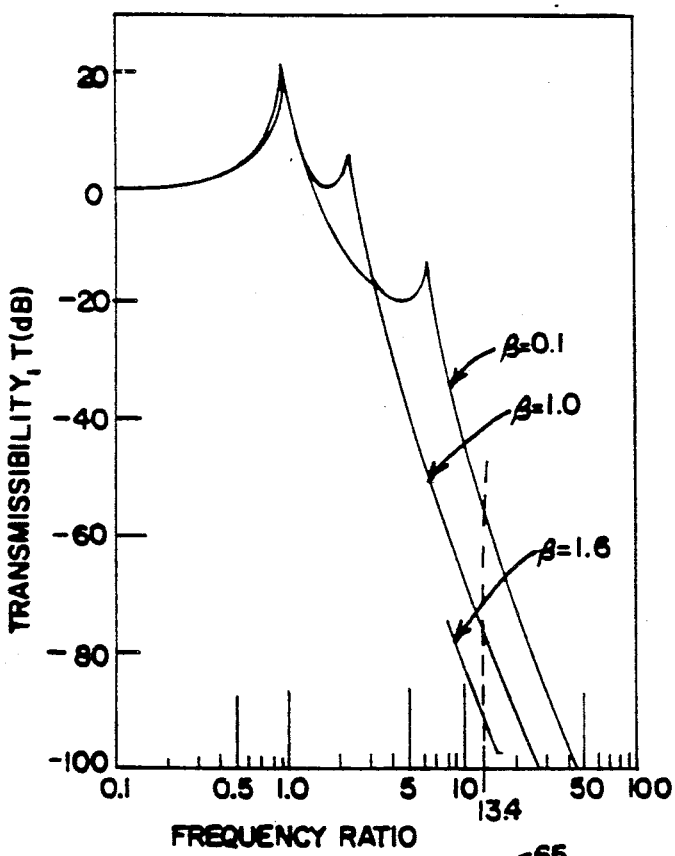
FIG. 4 is a graph illustrating the transmissibility of a spring mass system as a function of frequency for three values of $\beta$.

FIG. 4 illustrates the vibration transmissibility of a system with two degrees of freedom as a function of the frequency ratio of the system for various values of the mass ratio, $\beta$, wherein the frequency ratio represents the ratio of the frequency of the driven system to the natural frequency of the system. As is seen in FIG. 4, at the frequency ratio of interest, 13.4, the transmission of vibration from the excitation of the mass M1 to the frame resiliently supporting the mass M2 decreases as the mass ratio $\beta$ increases from 0.1 to 1.6. Therefore, by increasing the effective mass of the compressor housing M2 to increase the mass ratio $\beta$, the system of the present invention decreases the amount of vibration transmitted from the compressor to the refrigerator frame 32 and thus decreases the amount of noise generated thereby.

Figure 6A:
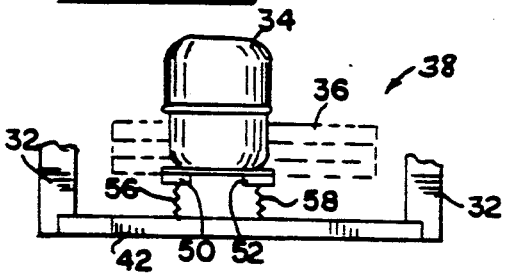
FIG. 6*a* is a diagram illustrating a rear view of the mounting system of FIG. 5.
Figure 6B:
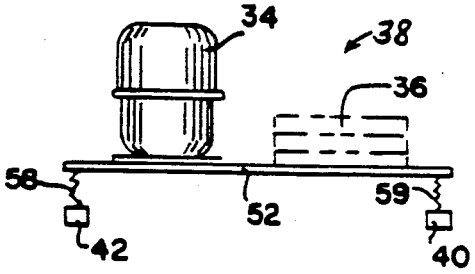
FIG. 6*b* is a diagram illustrating a side view of the mounting system of FIG. 5.

The mounting system 38 of the present invention, as shown in greater detail in FIGS. 5, 6A and 6B includes a pair of support rails 50 and 52 to which the compressor housing 34 is rigidly secured. The condenser 36 is also mounted across the support rails 50 and 52 and rigidly secured thereto. Rubber isolators, such as rubber grommets 56, 57, 58 and 59 are disposed between respective ends 60, 61, 62 and 63 of the support rails 50 and 52 and the cross rails 40, 42 to resiliently mount the support rails 50 and 52 to the cross rails 40 and 42 of the refrigerator frame 32. The ends 60–63 of the support rails 50 and 52 and the rubber grommets 56–59 are secured to the cross rails 42 and 40 by respective bolts 64, 65, 66 and 67 extending through apertures in the ends 60–63, grommets 56–59 and cross rails 42 and 40. Because the compressor housing 34 and condenser 36 are rigidly secured to the support rails 50 and 52 of the mounting system 38, and the mounting system 38 is resiliently secured to the cross rails 40 and 42 of the refrigerator frame 32, the effective mass of the compressor housing M2, is equal to the sum of the masses of the compressor housing 34, condenser 36 and support rails 50 and 52.

Figure 10:
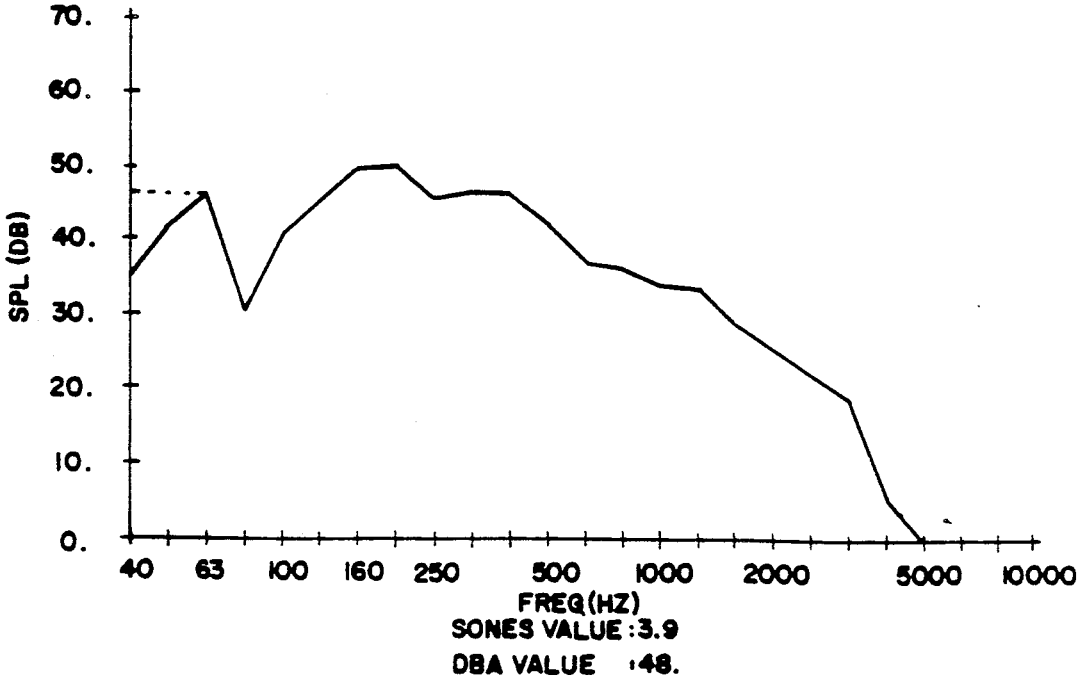
FIG. 10 is a graph illustrating the noise produced by a refrigerator having the compressor mounting system shown in FIG. 5.

The overall noise produced by a refrigerator employing the compressor mounting system shown in FIGS. 5, 6A and 6B is illustrated in FIG. 10. At the frequency of interest, 63 Hz, which represents the running speed of the compressor, the amount of radiated noise produced by a refrigerator having the mounting system of FIGS. 5, 6A and 6B is approximately 10 db below the amount of noise produced by a refrigerator having the prior art mounting system shown in FIG. 2.

Figure 8A:
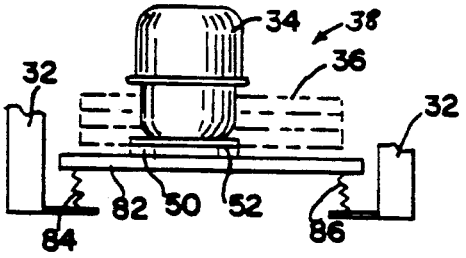
FIG. 8*a* is a diagram illustrating a rear view of the mounting system of FIG. 7.
Figure 8B:
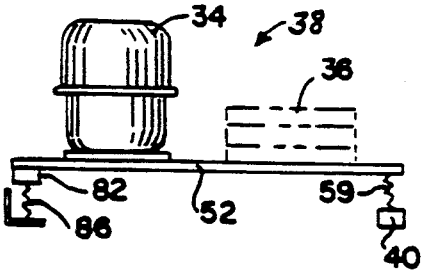
FIG. 8*b* is a diagram illustrating a side view of the mounting system of FIG. 7.

As shown in FIGS. 7, 8A and 8B, the second embodiment of the mounting system 38 includes the support rails 50 and 52 to which the compressor housing 34 is rigidly secured by means of bolts 53–55 and to which the condenser 36 is also rigidly secured. In this embodiment, the mounting system 38 also includes a rear cross rail 82 to which ends 60 and 62 of the respective support rails 50 and 52 are rigidly secured by spot welds 70 and 72 or the like. The ends 61 and 63 of the support rails 50 and 52 are resiliently secured to the cross rail 40 of the refrigerator frame 32 by grommets 57 and 59 as discussed above with reference to FIG. 5. A pair of rubber grommets 84 and 86 are disposed between the cross rail 82 of the mounting system of FIGS. 7, 8*a* and 8*b* and the refrigerator frame 32 to resiliently mount the cross rail 82 on the refrigerator frame 32. Because the cross rail 82 in FIGS. 7, 8*a* and 8*b* is rigidly secured to the support rails 50 and 52 to which the compressor housing 34 and condenser 36 are rigidly secured, the effective mass of the compressor housing M2 is equal to the sum of the masses of the compressor housing 34, the condenser 36, the support rails 50 and 52 and the cross rail 82 so as to further increase the mass ratio $\beta$ and to substantially reduce the transmission of vibration from the compressor resiliently mounted in the housing 34 to the frame 32 of the refrigerator 10. Tests of this embodiment (FIGS. 7, 8A and 8B) have also shown a 10 db reduction in radiated noise as compared with a refrigerator having the mounting system shown in FIG. 2 at the frequency associated with the compressor running speed.

In still another embodiment of the present invention, the support rails 50 and 52 may be rigidly secured to the cross rail 40 as well as to the cross rail 82 so that the grommets 57 and 59 shown in FIG. 7 would be replaced by spot welds or the like. Grommets 90 and 92 would then be used to resiliently secure the cross rail 40 to the frame 32 of the refrigerator 30. In this embodiment the effective mass of the compressor housing would include the compressor housing 34, the condenser 36, the support rails 50 and 52 and the cross rails 40 and 82 to increase the mass ratio $\beta$ and to reduce the amount of noise generated by the transmission of vibration from the compressor to the refrigerator frame.

Many modifications and variations of the present invention are possible in light of the above teachings. Thus, it is to be understood that, within the scope of the appended claims, the invention may be practiced otherwise than as described hereinabove.

What is claimed and desired to be secured by Letters Patent is:

1. In a refrigeration apparatus having a refrigerator frame, a compressor mounting system having multiple degrees of freedom comprising:

a compressor housing;

a compressor resiliently mounted in said compressor housing, said compressor having a first mass;

a condenser;

a support frame on which is rigidly secured said compressor housing and said condenser, said support frame, said compressor housing and said condenser having a second mass; and mounting means for resiliently mounting said support frame on said refrigerator frame to provide a multiple degree of freedom mounting system with said second mass being greater than said first mass so that radiated noise of the refrigeration apparatus at the running speed of the compressor is reduced.

2. A refrigeration apparatus as recited in claim 1 wherein said support frame includes a pair of support rails and said refrigerator frame includes a pair of cross rails, said resilient mounting means being disposed between a first end of each of said support rails and one of said cross rails and between a second end of each of said support rails and the other of said cross rails.

3. A refrigeration apparatus as recited in claim 1 wherein said resilient mounting means includes a plurality of rubber isolators.

4. A refrigeration apparatus as recited in claim 1 wherein said resilient mounting means includes a plurality of rubber grommets.

5. A refrigeration apparatus as recited in claim 1 wherein said compressor is a reciprocating compressor.

6. A refrigeration apparatus as recited in claim 1 wherein the ratio of said second mass to said first mass is at least 1.0.

7. A refrigeration apparatus as recited in claim 1 wherein the ratio of said second mass to said first mass is 1.6.

8. A method of minimizing vibration transmitted by a compressor in a refrigeration apparatus to the frame of the refrigeration apparatus, the compressor having a first mass, comprising the steps of:

providing a compressor housing for resiliently mounting said compressor therein;

providing a support frame for supporting said compressor housing and a condenser;

establishing a second mass by rigidly securing said compressor housing and said condenser to said support frame; and resiliently mounting said support frame to said refrigeration apparatus frame to provide a multiple degree of freedom mounting system with said second mass being greater than said first mass such that radiated noise of the refrigeration apparatus at the running speed of the compressor is reduced.

9. A method of minimizing vibration in a refrigeration apparatus as recited in claim 8 wherein said support frame includes a pair of support rails with first and second ends and said refrigerator frame includes a pair of cross rails, said method including the steps of resiliently mounting the first end of each of said support rails on one of said cross rails and resiliently mounting the second end of each of said support rails on the other of said cross rails.

* * * * *